US005376491A

United States Patent [19]

Krumberg et al.

[11] Patent Number: 5,376,491

[45] Date of Patent: Dec. 27, 1994

[54] ORGANIC PHOTOCONDUCTOR

[75] Inventors: Yakov Krumberg, Rehovot; Jakob Karin, Ramat Gan; Ehud Chatow, Petach Tikva, all of Israel

[73] Assignee: Indigo N.V., SM Veldhoven, Netherlands

[21] Appl. No.: 946,411

[22] PCT Filed: May 8, 1990

[86] PCT No.: PCT/NL90/00066

§ 371 Date: Jan. 5, 1993

§ 102(e) Date: Jan. 5, 1993

[87] PCT Pub. No.: WO91/17485

PCT Pub. Date: Nov. 14, 1991

[51] Int. Cl.[5] ..... G03G 5/05

[52] U.S. Cl. ..... 430/136; 430/134; 430/119

[58] Field of Search ..... 430/134, 60, 31, 136; 428/202

[56] References Cited

U.S. PATENT DOCUMENTS

| | | | |
|---|---|---|---|
| 3,717,462 | 2/1973 | Negishi et al. | 252/501 |
| 3,764,590 | 10/1973 | Mukon et al. | 260/85 |
| 3,806,340 | 4/1974 | Sato et al. | 430/45 |
| 4,286,039 | 8/1981 | Landa et al. | 430/119 |
| 4,326,005 | 4/1982 | Reed et al. | 428/202 |
| 4,387,148 | 6/1983 | Franke et al. | 430/66 |
| 4,497,566 | 2/1985 | Ng | 430/31 |
| 4,794,651 | 12/1988 | Landa et al. | 430/110 |
| 4,891,290 | 1/1990 | Narita | 430/58 |
| 4,894,304 | 1/1990 | Ueda | 430/58 |
| 5,032,481 | 7/1991 | Berwick et al. | 430/60 |

FOREIGN PATENT DOCUMENTS

| | | |
|---|---|---|
| 0046958 | 3/1982 | European Pat. Off. . |
| 1814644 | 7/1969 | Germany . |
| 1906969 | 8/1970 | Germany . |
| 2037450 | 11/1971 | Germany . |
| 2117058 | 4/1972 | Germany . |
| 2154145 | 5/1972 | Germany . |
| 59-9667 | 1/1984 | Japan . |
| 63-188153 | 8/1988 | Japan . |
| 1207037 | 9/1970 | United Kingdom . |

OTHER PUBLICATIONS

Partial English language translation of German Patent No., 1,906,969.

International Search Report and Annex.

*Primary Examiner*—John Goodrow

*Attorney, Agent, or Firm*—Sandler Greenblum & Bernstein

[57] ABSTRACT

An organic photoconductor including a base layer formed of a first material and a photoconductive layer formed of a second material. The organic photoconductor being characterized in that when it is maintained in a curved orientation with the photoconductive layer facing outward, the photoconductive layer is subjected to less stress than the base layer. In one embodiment the first material is relatively more flexible and stretchable than said second material and the materials are prestressed in opposite senses. In a second embodiment the first material is relatively flexible and stretchable and the second material is an initially less flexible and stretchable material which has been chemically treated to increase its stretchability and flexibility.

9 Claims, 2 Drawing Sheets

ORGANIC PHOTOCONDUCTOR

FIELD OF THE INVENTION

The present invention relates to photoconductors generally and more particularly to organic photoconductors.

BACKGROUND OF THE INVENTION

Various types of organic photoconductors are known. Most organic photoconductors are susceptible to attack by organic solvents of the type used in liquid toner electrophotography and are therefore unsuitable for such applications. These photoconductors include those which dissolve in the solvents and other which are caused to crack as the result of exposure thereto when they are under stress, especially when under tension.

It is known in the art to provide protective coatings for organic photoconductors. Examples of these coatings are given in U.S. Pat. Nos. 4,891,290 and 4,894,304.

SUMMARY OF THE INVENTION

The present invention seeks to provide an improved organic photoconductor which is resistant to cracking in a stressed environment wherein organic solvents of the type used in liquid toner electrophotography are present.

There is thus provided in accordance with a preferred embodiment of the present invention an organic photoconductor including a base layer formed of a first material and a photoconductive layer formed of a second material, the organic photoconductor being characterized in that when it is maintained in a curved orientation with the photoconductive layer facing outward, the photoconductive layer is subjected to less stress than the base layer. In accordance with a preferred embodiment of the invention the first material is relatively more flexible than the second material. In accordance with an alternative preferred embodiment of the invention the first material is relatively flexible and stretchable and the second material is an initially less flexible and stretchable material, which has been chemically treated to increase its stretchability and flexibility.

There is also provided in accordance with a preferred embodiment of the present invention an organic photoconductor including a base layer formed of a first material and a photoconductive layer formed of a second material, the base and photoconductive layers being pre-stressed in opposite senses.

There is further provided in accordance with a preferred embodiment of the present invention an organic photoconductor including a base layer formed of a first material and a photoconductive layer formed of a second material, the second material being chemically treated to relieve stress therein. In a preferred embodiment of the invention, the chemical treatment causes the photoconductive layer to become more flexible and stretchable. Preferably the photoconductive layer becomes more elastic or plastic.

Additionally in accordance with a preferred embodiment of the present invention there is provided a method for manufacturing an organic photoconductor including the steps of:

providing an organic photoconductor having a base layer and a photoconductor layer, and treating at least one of the base layer and photoconductive layer to relieve stress in the photoconductive layer.

Additionally in accordance with the above embodiment of the invention, the base layer of the organic photoconductor has greater flexibility and stretchability than the photoconductor layer.

Further in accordance with the above embodiment of the invention, the base layer has a stress relief temperature higher than that of the photoconductive layer.

Additionally in accordance with the preceding embodiment, the step of treating includes the steps of stressing the base layer and the photoconductive layer and while they are stressed, heating them to a temperature between the stress relief temperatures of the base layer and photoconductive layer.

In accordance with an alternative embodiment of the invention, the step of treating includes the step of chemically treating the photoconductive layer to soften and render it more elastic or plastic that it previously was.

Additionally in accordance with a preferred embodiment of the invention there is provided a liquid toner electrophotographic system including a drum, a photoconductive surface provided on the drum, apparatus for forming a latent image on the photoconductive surface, apparatus for liquid toner development of the latent image on the photoconductive surface and apparatus for transferring the image after development thereof to a final substrate, the photoconductive surface comprising an organic photoconductor sheet mounted onto the drum.

In accordance with a preferred embodiment of the invention, the photoconductor sheet is constructed and operative in accordance with any of the embodiments described above, alone or in suitable combination.

BRIEF DESCRIPTION OF THE DRAWINGS

The present invention will be understood and appreciated more fully from the following detailed description, taken in conjunction with the drawings in which.

DETAILED DESCRIPTION OF PREFERRED EMBODIMENT

Figure 1:
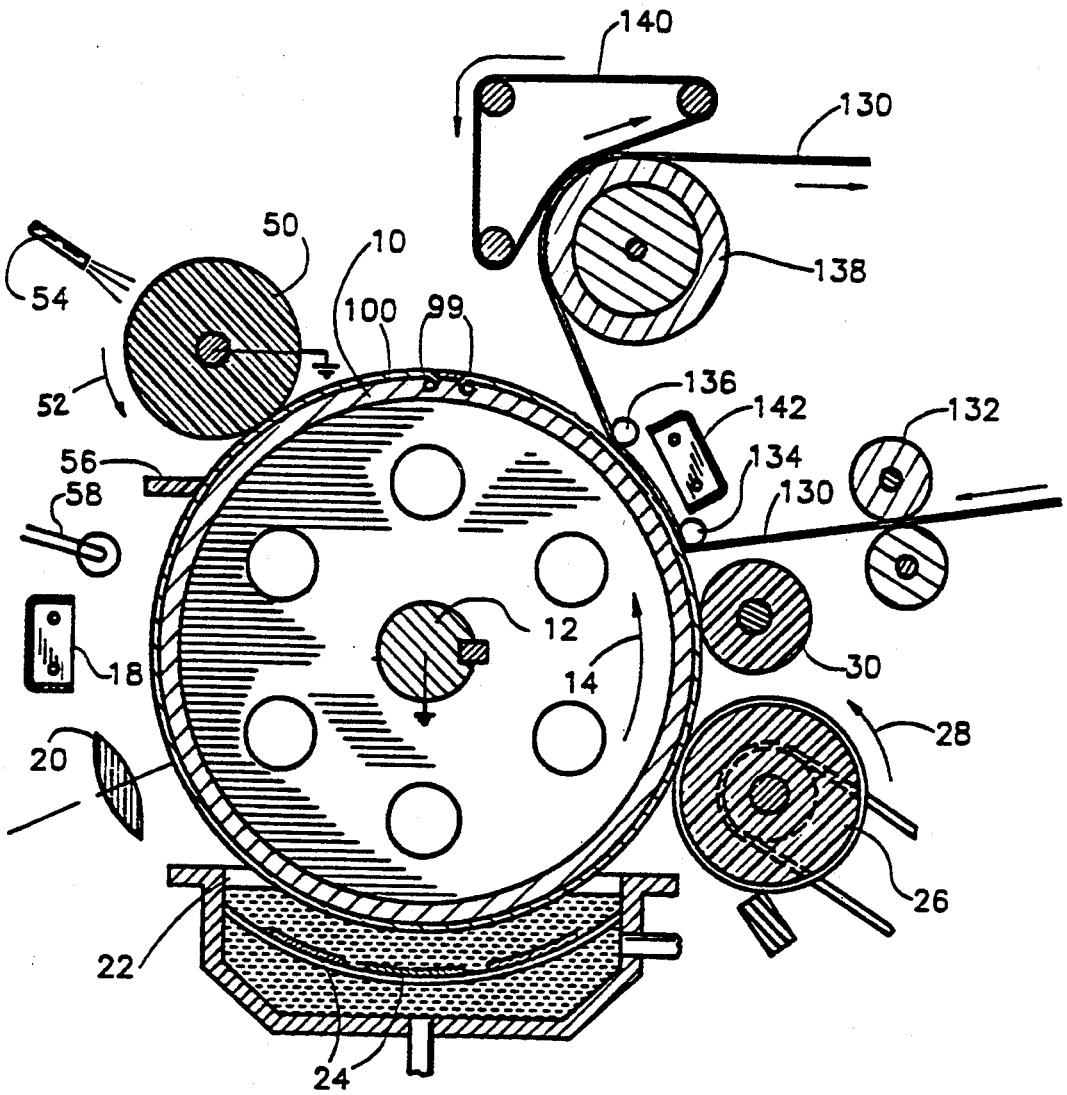
FIG. 1 is a simplified sectional illustration of liquid toner electrophotographic apparatus constructed and operative in accordance with a preferred embodiment of the present invention.

Reference is now made to FIG. 1 which illustrates liquid toner electrophotographic imaging apparatus constructed and operative in accordance with a preferred embodiment of the present invention. The invention is described for liquid developer systems with negatively charged toner particles, and negatively charged photoconductors, i.e., systems operating in the reversal mode. For other combinations of toner particle and photoconductor polarity, the values and polarities of the voltages are changed, in accordance with the principles of the invention.

The invention can be practiced using a variety of liquid developer types but is especially useful for liquid developers comprising carrier liquid and pigmented polymeric toner particles. In a preferred embodiment of the invention the carrier liquid is a solvent such as Isopar (Exxon). Examples of such developers are given in U.S. Pat. No. 4,794,651, the disclosure of which is included herein by reference.

As in conventional electrophotographic systems, the apparatus of FIG. 1 typically comprises a drum 10 arranged for rotation about an axle 12 in a direction generally indicated by arrow 14. An organic photoconductor 100 is mounted on the drum and is stretched tight by stretchers 99.

A corona discharge device 18 is operative to generally uniformly charge organic photoconductor 100 with a negative charge. Continued rotation of drum 10 brings charged organic photoconductor 100 into image receiving relationship with an exposure unit including a lens 20, which focuses an image onto charged organic photoconductor 100, selectively discharging the photoconductor, thus producing an electrostatic latent image thereon. The latent image comprises image areas at a given range of potentials and background areas at a different potential. The image may be laser generated as in printing from a computer or it may be the image of an original as in a copier.

Continued rotation of drum 10 brings charged photoconductor 100, bearing the electrostatic latent image, into a development unit 22 including charged developer plates 24. Development unit 22 is operative to apply liquid developer, comprising a solids portion including pigmented toner particles and a liquid portion including carrier liquid preferably an organic liquid, to develop the electrostatic latent image. The developed image includes image areas having pigmented toner particles thereon and background areas.

While development unit 22 is shown as a single color developer of a conventional type, it may be replaced by a plurality of single color developers for the production of full color images as is known in the art. Alternatively, full color images may be produced by changing the liquid toner in the development unit when the color to be printed is changed. Alternatively, highlight color development may be employed, as is known in the art.

In accordance with a preferred embodiment of the invention, following application of toner thereto, photoconductor 100 passes a typically charged rotating roller 26, preferably rotating in a direction indicated by an arrow 28. Typically the spatial separation of roller 26 from photoconductor 100 is about 50 microns. Roller 26 thus acts as a metering roller as is known in the art, reducing the amount of carrier liquid on the background areas and reducing the amount of liquid overlaying the image.

Preferably the potential on roller 26 is intermediate that of the latent image areas and of the background areas on the photoconductor. Typical approximate voltages are: roller 26: −200 V to −800 V, background area: −1000 V and latent image areas: −150 V.

The liquid toner image which passes roller 26 should be relatively free of pigmented particles except in the region of the latent image.

Downstream of roller 26 there is preferably provided a rigidizing roller 30. Rigidizing roller 30 is preferably formed of resilient polymeric material, such as polyurethane which may have only its natural conductivity or which may be filled with carbon black to increase its conductivity.

According to one embodiment of the invention, roller 30 is urged against photoconductor 100 as by a spring mounting (not shown). The surface of roller 30 typically moves in the same direction and with the same velocity as the photoconductor surface to remove liquid from the image.

Preferably, the biased squeegee described in U.S. Pat. No. 4,286,039, the disclosure of which is incorporated herein by reference, is used as the roller 30. Roller 30 is biased to a potential of at least several hundred and up to several thousand Volts with respect to the potential of the developed image on photoconductor 100, so that it repels the charged pigmented particles and causes them to more closely approach the image areas of photoconductor 100, thus compacting and rigidizing the image.

In a preferred embodiment of the invention, rigidizing roller 30 comprises an aluminum core having a 20 mm diameter, coated with a 4 mm thick carbon-filled polyurethane coating having a Shore A hardness of about 30–35, and a volume resistivity of about $10^8$ ohm-cm. Preferably roller 30 is urged against photoconductor 100 with a pressure of about 40–70 grams per linear cm of contact, which extends along the length of the drum. The core of rigidizing roller 30 is energized to between about −1800 and −2800 volts, to provide a voltage difference of preferably between about 1600 and 2700 volts between the core and the photoconductor surface in the image areas.

Under these conditions and for the preferred toner, the solids percentage in the image portion is believed to be as high as 35% or more. It is preferable to have an image with at least 25–30% solids, after rigidizing.

Downstream of rigidizing roller 30 there is provided apparatus for direct transfer of the image from organic photoconductor 100 to a substrate 130 such as paper. The direct transfer is effected by the provision of guide rollers 132, 134 and 136, which guide a continuous web of substrate 130, and a drive roller 138, which cooperates with a support web 140. A suitable charging device, such as corona discharge device 142, charges the substrate at a transfer location, for effecting electrophoretic transfer of the image from photoconductor 100 to substrate 130.

Following transfer of the toner image to substrate 130, photoconductor 100 is engaged by a cleaning roller 50, which typically rotates in a direction indicated by an arrow 52, such that its surface moves in a direction opposite to the movement of adjacent surface of photoconductor 100 which it operatively engages. Cleaning roller 50 is operative to scrub and clean photoconductor 100. A cleaning material, such as toner or another cleaning solvent, may be supplied to the cleaning roller 50, via a conduit 54. A wiper blade 56 completes the cleaning of the photoconductor surface. Any residual charge left on photoconductor 100 is removed by flooding the photoconductor surface with light from a lamp 58.

In a multi-color system, subsequent to completion of the cycle for one color the cycle is sequentially repeated for other colors which are sequentially transferred from photoconductor 100 to substrate 130.

Alternatively the direct transfer apparatus may be replaced by an intermediate transfer member which receives the images from photoconductor 100 and transfers them to the final substrate.

Figure 2:
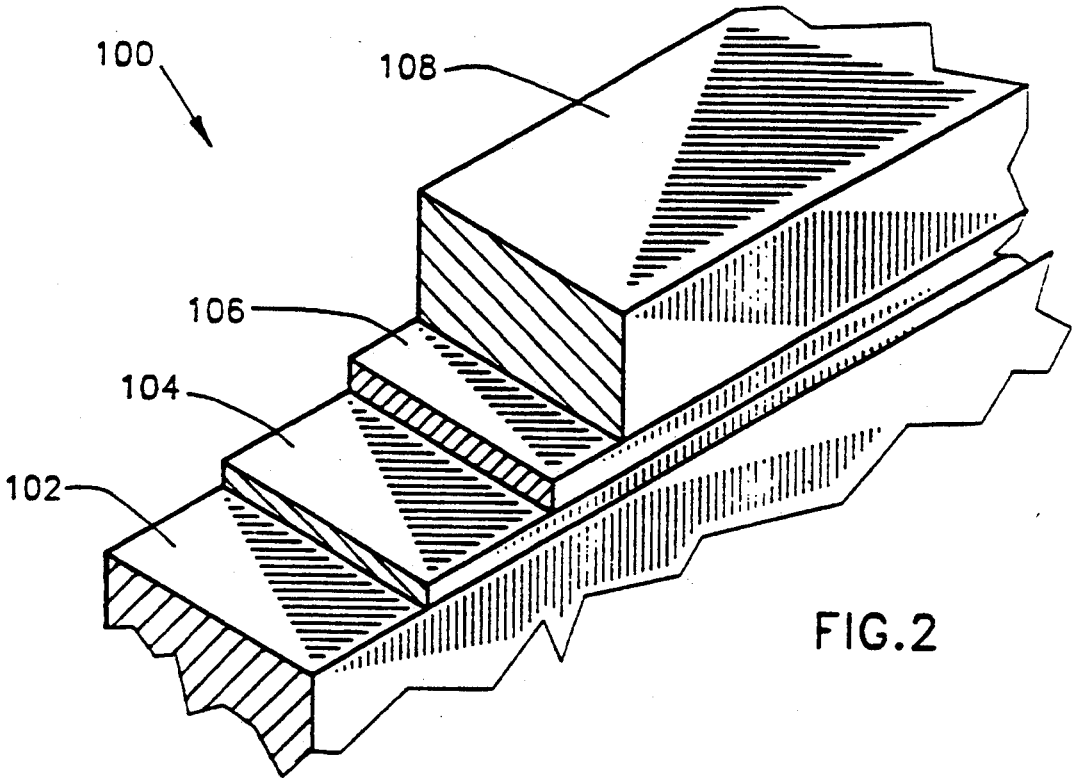
FIG. 2 is a simplified illustration of an organic photoconductor sheet useful in the embodiment of FIG. 1.

FIG. 2 illustrates a preferred organic photoconductor sheet 100, useful in the embodiment of FIG. 1. The sheet comprises a base layer 102, typically formed of Aluminized Polyethylene Telephthalate, which is commercially available under the trademark Mylar. The base layer is preferably about 80 microns in thickness and has a melting point of 250° C.

Disposed above the base layer 102 is a sublayer 104, typically formed of Polyester, Toluenesulfonamide-formaldehyde resin and Polyamide and having a thickness of about 0.2 microns. Disposed above the sublayer 104 is a charge generation layer 106, typically formed of Hydroxysquarylium Dye and Toluenesulfonamide-resin and having a thickness of about 0.3 microns.

Disposed above layer 106 is a charge transport layer 108, typically formed of Polyester, Polycarbonate, Yellow Dye, 4-[N,N-diethylamino] benzaldehydedipenylhydrazone and Polysiloxane in a minor proportion, having a thickness of about 18 microns. Charge transport layer 108 and charge generation layer 106 together define the photoconductive layer referred to above.

The organic photoconductor described so far is commercially available from IBM Corporation under the trade name Emerald.

Figure 3:
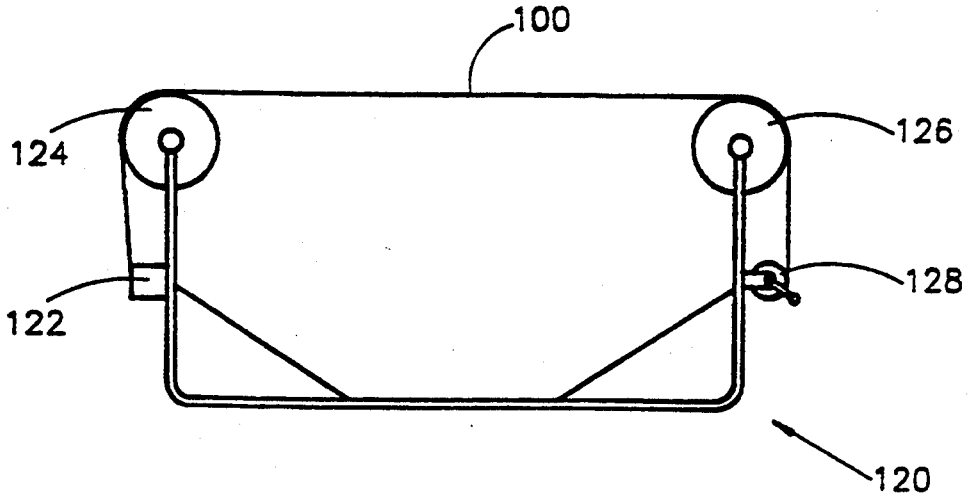
FIG. 3 is a detailed illustration of pre-stressing of the photoconductor in accordance with an embodiment of the present invention.

In accordance with an embodiment of the present invention, and as illustrated in FIG. 3, the organic photoconductor, as received from IBM Corporation, is subjected to an annealing procedure which will now be described in detail.

According to one embodiment of the invention, organic photoconductor 100 is mounted on a stretcher 120 and tensioned to a strain of 3 Kg per cm of width of photoconductor 100. While subject to the above strain, photoconductor 100 is heated, preferably in an oven (not shown) to a temperature of 60° C., for about 30 minutes. Thereafter, photoconductor 100 is cooled to room temperature and thereafter, the external stress is removed therefrom.

It is noted that the temperature of 60 degrees lies intermediate the stress relief temperature of base layer 102, which is approximately 150° C. and the glass transition temperature of charge transport layer 108, which is approximately 45° C.

After treatment in the manner described above, i.e., after the external stress is removed from sheet photoconductor 100, charge transport layer 108 of photoconductor 100 remains stressed under compression, while base layer 102 remains stressed under tension. When photoconductor 100 is mounted on drum 10 as illustrated in FIG. 1, and subject to external tension, charge transport layer 108 is either in compression or becomes relatively free of stress, and therefore is less susceptible to cracking or other defect generation as the result of exposure to organic solvents, such as Isopar, which are common in a liquid toner electrophotographic environment.

For example, an organic photoconductor 100 which was not annealed as described above, developed cracks after about 500 copy cycles in a liquid toner copier. In contrast, an organic photoconductor which was treated as described above developed no cracks, even after several tens of thousands of copy cycles. It should be noted that annealing the sheet photoconductor without subjecting it to simultaneous tension does not substantially improve the Isopar resistance of the photoconductor.

In accordance with an alternative embodiment of the present invention, organic photoconductor 100 may be treated chemically to reduce stress cracking in a liquid toner environment. In accordance with this embodiment, the charge transport layer is treated with a solvent or other reagent to soften charge transport layer 108 and to render it more stretchable, i.e., more plastic or elastic than it was previously.

The chemical treatment is selected so as to leave the electrical and optical characteristics of the photoconductor essentially unchanged. When such a chemically treated photoconductor sheet is stretched around drum 10, stress does not develop in charge transport layer 108. Accordingly, when stretched photoconductor 100 is exposed to organic solvents it does not tend to crack.

A specific chemical treatment which has been found to be effective is dipping of photoconductor 100 in cyclohexanone diluted by isopropyl alcohol in the ratio 1:5 for 2 minutes. This treatment does not significantly change the electrical and optical characteristics of the photoconductor but eliminates cracking as described above.

An alternative chemical treatment employs cyclohexanone alone or vinyl modified epoxy 1A24, commercially available from HumiSeal Division of Columbia Chase Corporation of Woodside, N.Y., diluted 1:20 with cyclohexanone. These materials can be applied by a wire-rod technique on the top surface of photoconductor 100. In such a case, an RK Print-Coat Instrument Ltd. of Litlington, Royston, Merts., UK, Model KCC 303 coater, using bar #2 (rod diameter 13 mm, wire diameter 0.15 mm) may be operated with bar linear speed of 70 mm/sec.

If pure cyclohexanone is used, then the results are similar to those for dipping, and the solvent evaporates within about 20–30 seconds.

If the mixture of cyclohexanone and epoxy is used, then in addition to the above described effects of the cyclohexanone, the residual vinyl modified epoxy forms a mechanically protective overcoating which is substantially adhesive to toner particles after the evaporation of the solvent.

It will be appreciated by persons skilled in the art that the present invention is not limited by what has been particularly shown and described hereinabove. Rather the scope of the present invention is defined only by the claims which follow:

We claim:

1. A method of manufacturing a photoconductor for use in an electrostatic imaging machine, including:

providing an organic photoconductor having a base layer and a photoconductive layer;

placing the photoconductor in a curved configuration, the photoconductive layer facing outward, wherein tension is applied to the photoconductive layer;

heat treating the stressed organic photoconductor to relieve stress in the photoconductive layer without relieving stress in the base layer;

releasing the organic photoconductor from the curved configuration after the organic photoconductor has cooled and prior to its use.

2. A method according to claim 1 wherein the base layer has a strain relief temperature higher than that of the photoconductive layer.

3. A method according to claim 2 wherein heat treating include:

heating the stressed organic photoconductor to a temperature between the stress relief temperatures of the base layer and photoconductive layer.

4. A method according to claim 3 and also including:

cooling the base layer and photoconductive layer while they are stressed after the step of heat treating; and removing the external stress from the base layer and photoconductive layers without forming an image on the photoconductor.

5. An organic photoconductor manufactured according to the method of claim 1.

6. A liquid toner electrophotographic system comprising:

a drum;

an organic photoconductor according to claim 5, disposed on the surface of the drum;

means for forming a latent image on the photoconductive surface;

means for liquid toner development of the latent image on the photoconductive surface; and means for transferring the image after development thereof to a final substrate.

7. A method of manufacturing a photoconductor including:

providing an organic photoconductor having a base layer and a photoconductive layer;

stressing the organic photoconductor;

heat treating the stressed organic photoconductor to relieve stress in the photoconductive layer without relieving the stress in the base layer;

cooling the organic photoconductor without removing the stress therefrom; and removing the external stress from the photoconductor prior to forming an image on the photoconductor.

8. An organic photoconductor manufactured according to the method of claim 7.

9. A liquid toner electrophotographic system comprising:

a drum;

an organic photoconductor according to claim 8, disposed on the surface of the drum;

means for forming a latent image on the photoconductive surface;

means for liquid toner development of the latent image on the photoconductive surface; and means for transferring the image after development thereof to a final substrate.

* * * * *